US006811423B2

(12) United States Patent
Yoshigi et al.

(10) Patent No.: US 6,811,423 B2
(45) Date of Patent: Nov. 2, 2004

(54) ELECTRICAL CONNECTOR ASSEMBLY HAVING A MECHANISM FOR ASCERTAINING ENGAGED CONDITION

(75) Inventors: Toshimasa Yoshigi, Shizuoka (JP); Hiroyuki Yada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 50 days.

(21) Appl. No.: 10/298,959

(22) Filed: Nov. 19, 2002

(65) Prior Publication Data

US 2003/0100213 A1 May 29, 2003

(30) Foreign Application Priority Data

Nov. 26, 2001 (JP) ..... 2001-359795

(51) Int. Cl.[7] ..... H01R 13/62; H01R 13/213
(52) U.S. Cl. ..... 439/315; 439/318
(58) Field of Search ..... 439/315, 314, 439/318, 489

(56) References Cited

U.S. PATENT DOCUMENTS 3,601,764 A * 8/1971 Cameron ..... 439/315
4,059,324 A * 11/1977 Snyder et al. ..... 439/321
4,289,368 A * 9/1981 Schildkraut ..... 439/320
4,290,662 A * 9/1981 Storcel ..... 439/320
5,662,488 A * 9/1997 Alden ..... 439/314
6,039,594 A * 3/2000 Zuppa ..... 439/318
6,336,822 B1 * 1/2002 Luzzoli ..... 439/315
6,561,841 B2 * 5/2003 Norwood et al. ..... 439/489
6,679,724 B2 * 1/2004 Hillman et al. ..... 439/489

FOREIGN PATENT DOCUMENTS

JP 4-132178 5/1992
JP 10-154553 6/1998

* cited by examiner

*Primary Examiner*—Hae Moon Hyeon
(74) *Attorney, Agent, or Firm*—Armstrong, Kratz, Quintos, Hanson & Brooks, LLP

(57) ABSTRACT

A first mark (28) is provided on a rotatable member (4), or on a connector (3) on which the rotatable member (4) is rotatably mounted. A second mark (30) is provided on the connector (3) on which the rotatable member (4) is rotatably mounted, or on the rotatable member (4) so as to be ascertained whether or not a pair of connectors (2), (3) are fully engaged with each other. Thus, a full engagement condition is ascertained without additional parts. Preferably, the first mark (28) or the second mark (30) is a projecting part (28) provided on the engaging arm (27) which is mounted resiliently on the rotatable member (4) or on the connector (3) on which the rotatable member (4) is rotatably mounted. Also preferably, the second mark (30) or the first mark (28) is the engaging part (30) with which the projecting part (28) is engaged.

4 Claims, 7 Drawing Sheets

ELECTRICAL CONNECTOR ASSEMBLY HAVING A MECHANISM FOR ASCERTAINING ENGAGED CONDITION

BACKGROUND OF THE INVENTION

1. Field of the Invention

The present invention relates to a pair of electrical connectors to be engaged with each other with a slight effort.

2. Description of the Related Art

Heretofore, there is an electrical connector assembly to electrically connect a transmission installed in a vehicle to interior wiring thereof such as a multiway connector assembly (e.g. 16 way). This multiway connector assembly accommodates and retains a plurality of terminals in rooms of a male connector housing thereof. Then, this male connector is engaged fully with a female mating connector accommodating a plurality of terminals, so that the terminals of the connectors are respectively engaged and electrically connected. With the multiway connector assembly where the housing accommodates numbers of terminals, engaging of the connectors needs a high insertion force. Accordingly, a heavy effort to engage connectors makes workers fatigued badly. Therefore, some circular engaging connectors equipped with rotating parts (bayonet connectors) are proposed to lighten the effort.

As a circular engaging connector assembly, there is an electric connector assembly such as described in JP-A4-132178 issue bulletin or described in JP-A10-154553. (The term "JP-A" as herein means "unexamined published Japanese patent application")

As shown in FIG. 9, the former electric connector assembly has a male connector 40 and a female connector 41 accommodating contact terminals 42, 43 respectively. The male connector 40 is engaged with a locking hood 44 and holds the hood rotatably. By initially engaging the connectors 40, 41 with each other, a projection 45 formed on an inner wall of the locking hood 44 is brought into a position of an opening part of a spiral groove 46 formed upon an exterior surface of the female connector 41.

Under the initial engaging of the connectors 41, 40, the projection 45 makes contact with a wall forming the spiral groove 46 and presses the wall by rotating the locking hood 44. Accordingly, the female connector 41 is urged to shift to the direction of an engaging position, so that the projection 45 reaches a dead end of the spiral groove 46 and the connectors 41, 40 are fully engaged and electrically connected with each other.

Torque of the locking hood 44 is magnified into a large force in a direction of engaging by an inclined plane of the spiral groove 46, so that the effort to engage the connectors 40, 41 is reduced.

As shown in FIG. 10, the latter electrical connector assembly has a rotatable member 51 and a detection tool 52. After the initial engaging of male and female connectors, the member 51 rotatably mounted on the male connector 50 is so rotated as to engage with the female connector. Consequently, the male connector 50 is moved toward the engagement position. Thus, the male and female connectors are fully engaged and electrically connected with each other. The detection tool 52 is so mounted on the male connector as to ascertain whether the connectors are fully engaged with each other. That is, when engaging the connectors fully with each other by rotating the member 51, an engaging projection 54 of the detection tool 52 is engaged with an engaging recess 55 of the rotatable member 51 by inserting fully the detection tool 52 into an accommodating part 53. On the contrary, when engaging the connectors insufficiently with each other by insufficient rotation of the member 51, the engaging projection 54 of the detection tool 52 is not engaged with the engaging recess 55 of the rotatable member 51. Consequently, after rotating the rotatable member 51, a engaging condition of connectors is ascertained easily by whether the engaging projection 54 of the detection tool 52 is engaged with the engaging recess 55 of the rotatable or not.

In the above mentioned former connector assembly, the projection of the male connector reaches the dead end of the spiral groove of the female connector by rotating the rotatable member of the male connector, so that the connectors are fully engaged. A judgement of the full engaging is done by rotating the rotatable member to stop moving, because the rotatable member cannot rotate further when the projection reaches the dead end of the spiral groove. Thus, the judgement of the full engaging depends on operator's sense of detecting a change of torque mostly. It is difficult to ascertain the full engaging by visual observation. As a result, for example, when some trouble happens, it may mislead the sense of detecting the change of torque into believing that the rotatable member is sufficiently rotated despite the insufficient rotation. Thus, there is a possibility of occurrence that the engaging of the connectors is insufficient in the former connector assembly.

In this regard, it is easy to ascertain the condition of engaging in the latter connector assembly by mounting the detection tool on the male connector. The detection tool is housed in the accommodating part. The condition of engaging is ascertained by whether the engaging projection of the detector tool is engaged with the recess of the rotatable member. However, the latter connector assembly requires the detection tool in addition to the male connector, the female connector and the rotatable member. The number of the component parts is increased in the latter connector assembly.

SUMMARY OF THE INVENTION

The present invention has been accomplished to solve the above described problems and an object of the present invention is to provide an electric connector assembly for ascertaining the full engaging condition of the connectors easily without an increase of component parts thereof.

In the connector assembly of the invention, a pair of connectors is engaged fully with each other by being engaged initially with each other, secondly being rotated the member mounted rotatably on either of the connectors, and thirdly being moved at least either of the connectors toward the engaging point.

In order to achieve the invention, according to a first aspect of the invention, in the above connector assembly, a first mark is provided on either the rotatable member or one of the connectors on which the member is mounted. A second mark is so provided on either said one of the connectors on which the member is mounted or the rotatable member as to be ascertained whether the pair of the connectors is fully engaged with each other.

In such a configuration, it is possible to ascertain whether the pair of the connectors is fully engaged with each other by the first mark either the rotatable member or one of the connectors and the second mark provided on either said one of the connectors or the rotatable member. Thus, it is possible to ascertain whether the pair of the connectors is fully engaged with each other without the increase of the component parts in the connector assembly.

According to a second aspect of the invention, it is preferable that either the first or second mark is a projection provided on an engaging arm which is mounted resiliently on either the rotatable member or one of the connectors, and either of the marks is the engaging recess where the projection is engaged.

Thus, the full engaging condition of the connectors is ascertained on sight. Because if the pair of connectors is fully engaged, the projection is engaged with the engaging recess, and if not, the projection is not engaged with the engaging recess. Further, when the pair of connectors is fully engaged, the projection is engaged with the engaging recess, so that the rotatable member holds the full engaging condition.

According to a third aspect of the invention, it is preferable that an initial engagement recess is provided on either one of the connectors on which the member is mounted or the rotatable member. The initial engagement recess is so engaged with the projection as to hold the rotatable member in an initial engaging position.

Thus, it is not difficult to engage a pair of connectors without rotating the rotatable member, because the member is held in the initial engaging position by engaging the projection with the initial engagement recess. That is, the initial engaging is done without interference of the rotating parts.

According to a forth aspect of the invention, it is preferable that the projection and/or the engaging arm and the engaging recess are made of synthetic resin. Using the synthetic resin, when the projection enters the engaging recess caused by restitutive force, a locking sound is made from a contact between the projection and the engaging recess and/or a contact between the engaging arm and a wall of the engaging recess. The engaging arm bent by rotation of the rotatable member produces the above-described restitutive force.

In such a configuration, the locking sound is made when the pair of connectors is fully engaged by rotating the rotatable member, so that it is possible to ascertain whether the pair of connectors is fully engaged by hearing the sound.

DESCRIPTION OF THE PREFERRED EMBODIMENT

Figure 1:
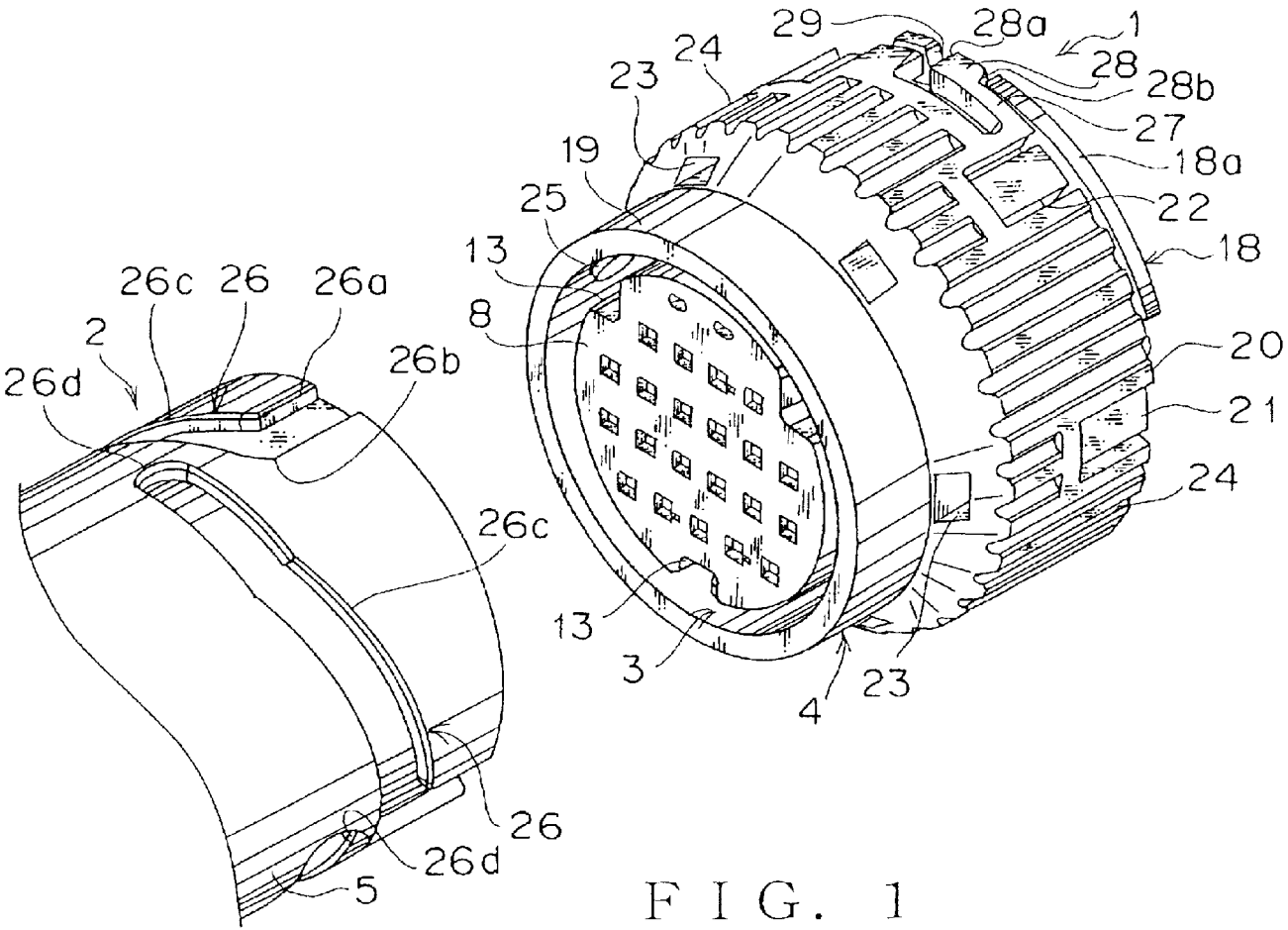
FIG. 1 is a perspective view of one embodiment of an electrical connector assembly in accordance with the present invention.

Now, an embodiment according to the present invention will be described in detail referring to the drawings.

Figure 4:
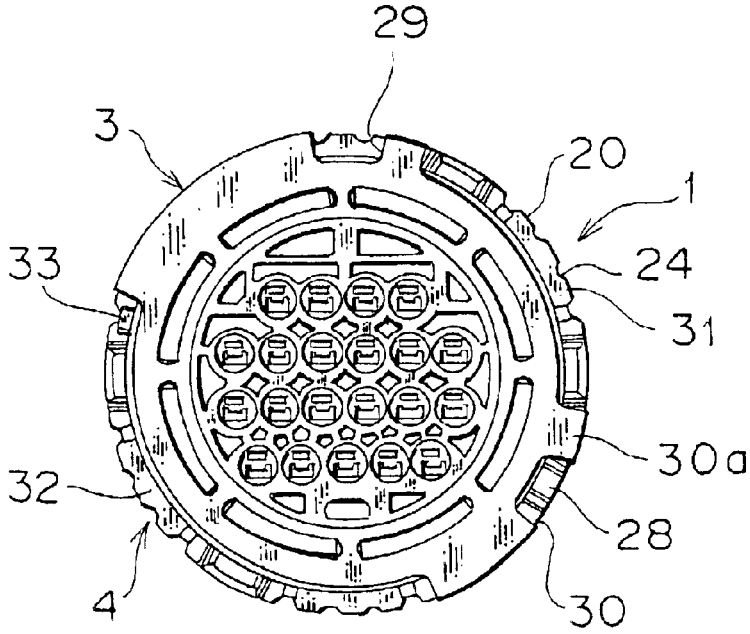
FIG. 4 is a rear view showing a full engaging of the connectors.
Figure 5:
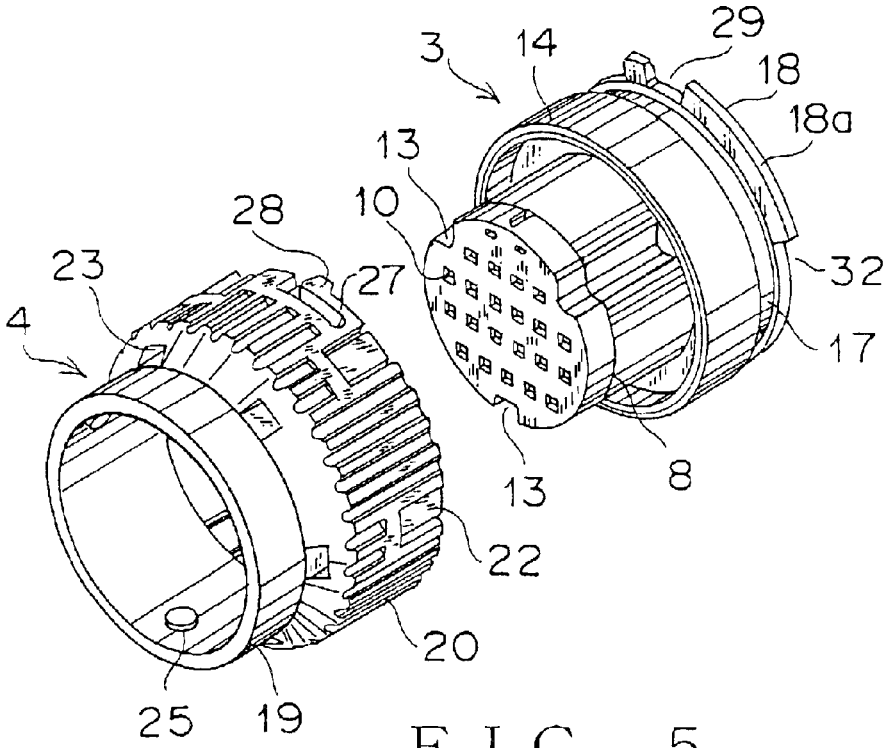
FIG. 5 is a perspective view of one embodiment of a rotatable member and a male connector in accordance with the present invention.
Figure 6:
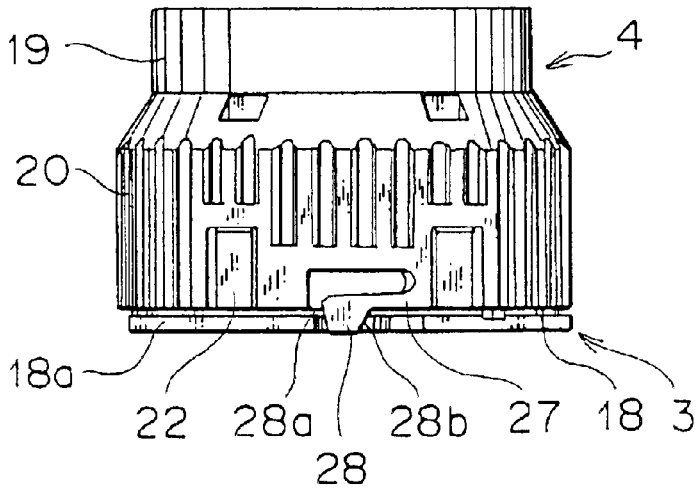
FIG. 6 is a side view showing a condition of the rotatable member mounted rotatably on the male connector.
Figure 8:
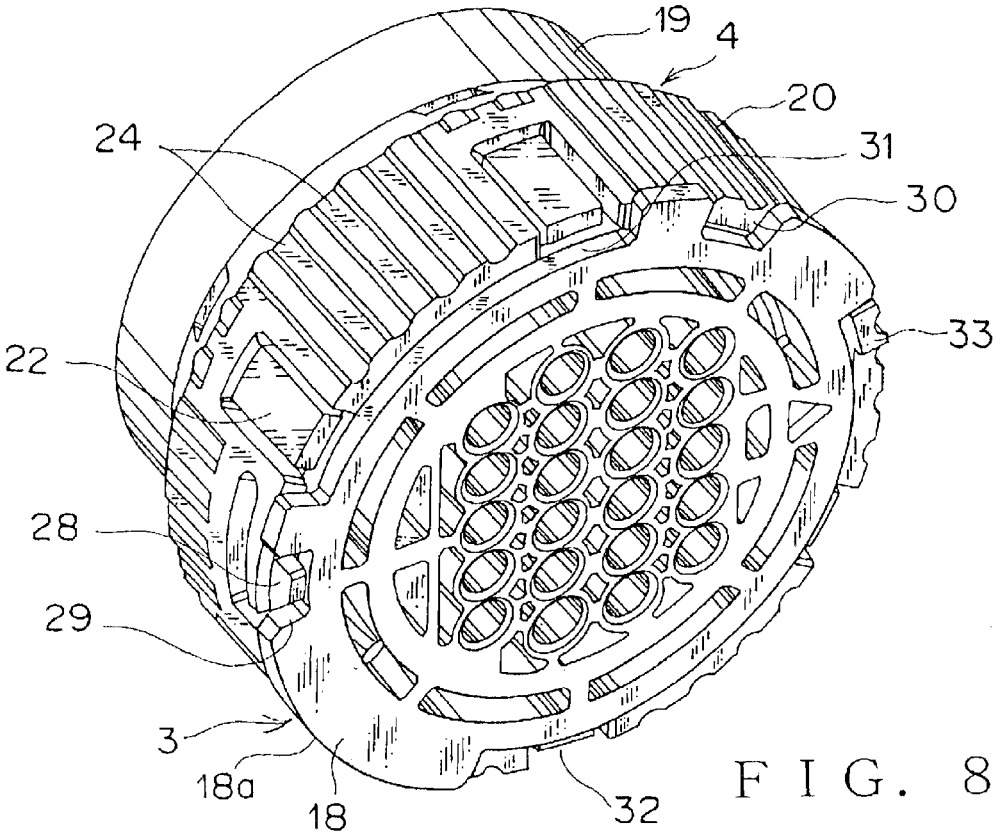
FIG. 8 is a perspective view showing the condition of the rotatable member mounted rotatably on the male connector.
Figure 9:
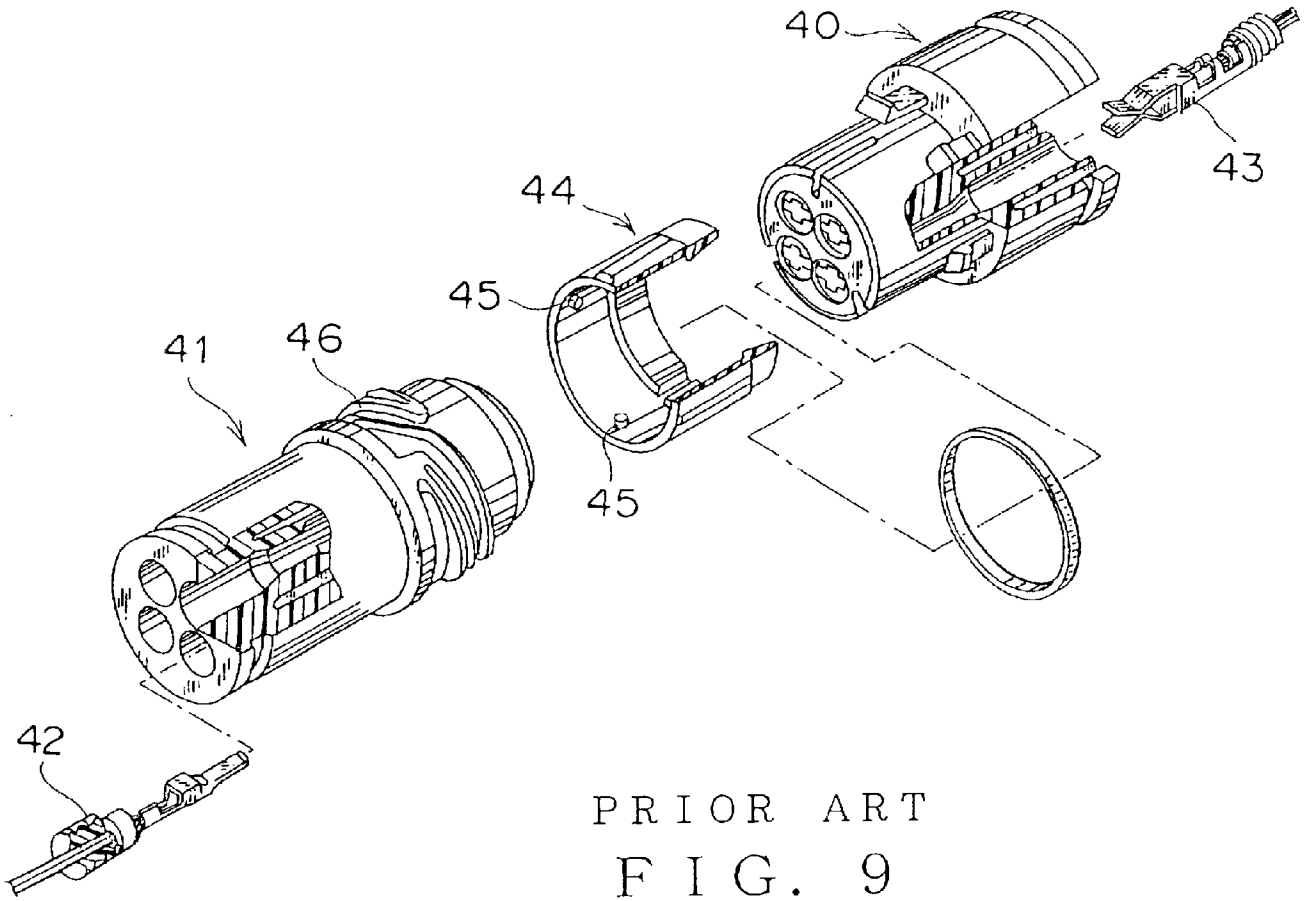
PRIOR ART FIG. 9
FIG. 9 is a perspective view of a first embodiment of conventional electric connectors.
Figure 10:
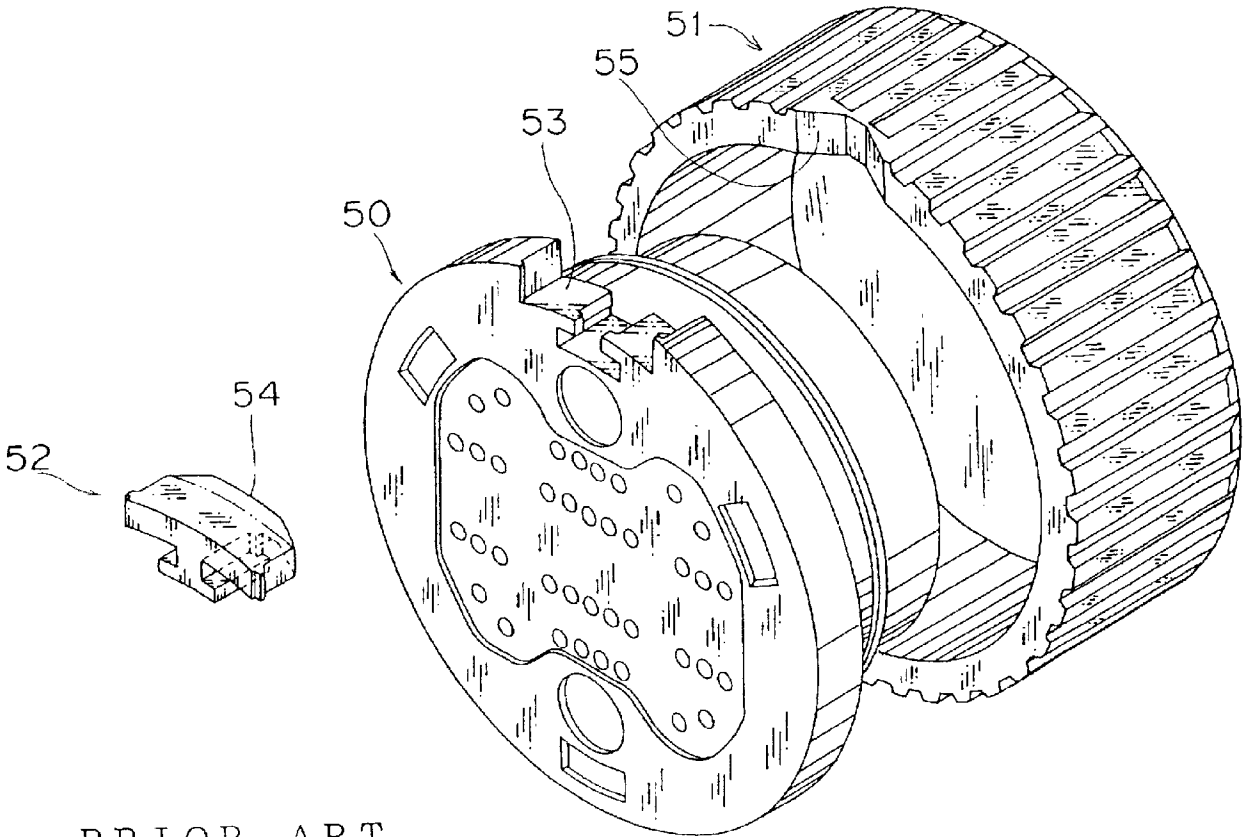
PRIOR ART FIG. 10
FIG. 10 is a perspective view of a second embodiment of conventional electric connectors.

FIG. 1 or FIG. 4 shows an embodiment of an electric connector assembly in the present invention. FIG. 5 or FIG. 8 shows an embodiment of a rotatable member and a male connector in the present invention. In FIG. 1 or FIG. 4, a connector assembly 1 is a rotating engaging connector (bayonet connector). A pair of a male connector 3 and a female connector 2 is shifted from a initial engaging condition to a full engaging condition by rotating the rotatable member, so that the connectors 2, 3 are electrically connected with each other in the connector assembly 1.

Figure 2:
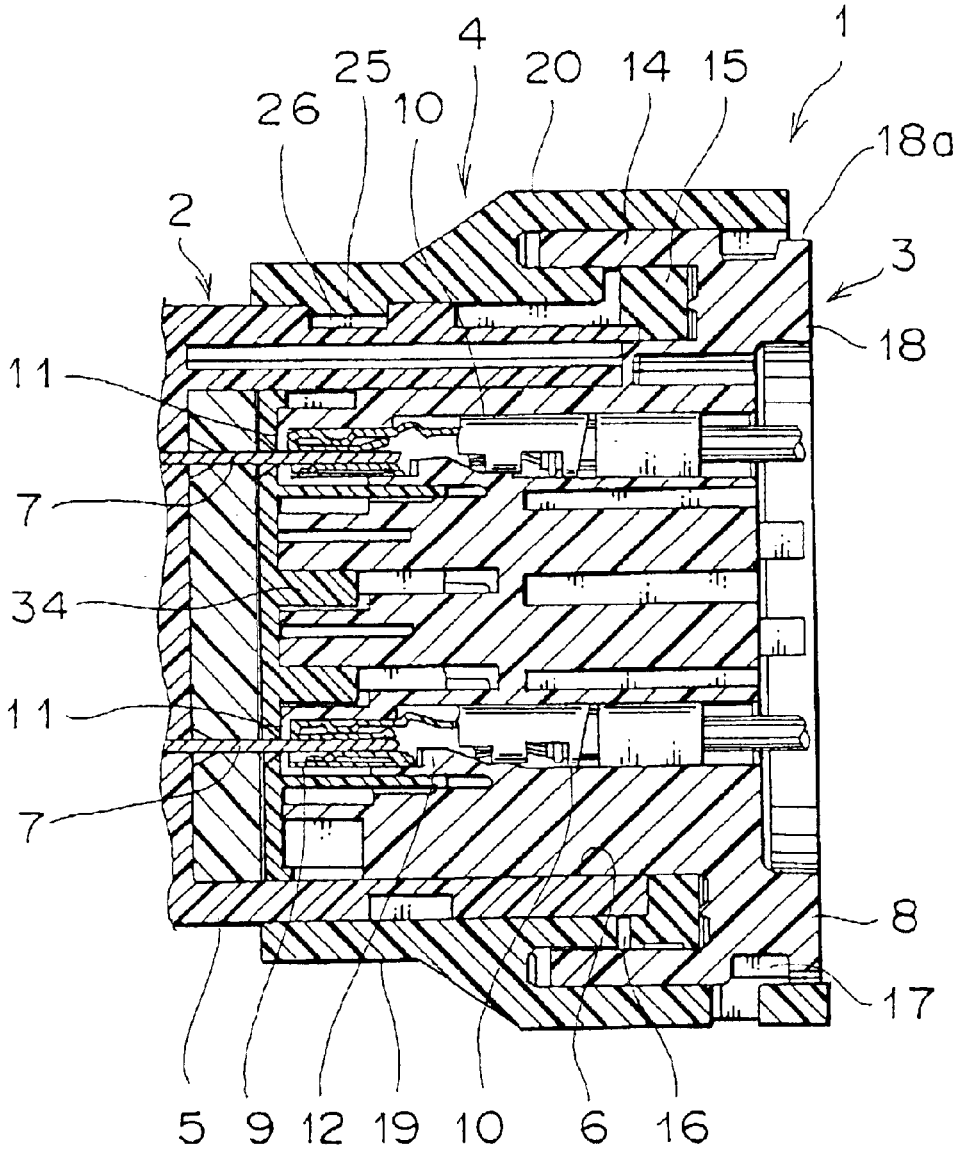
FIG. 2 is a cross sectional view showing an engaging condition of a pair of the connectors in accordance with the present invention.

As shown in FIG. 1 and FIG. 2, a female connector housing 5 of the female connector 2 is made cylindrically of insulating material. A front interior in an axial direction of the female connector housing 5 is provided as an engaging part 6 where the male connector 3 is engaged. A plurality of tab-shaped male terminals 7, such as 21 terminals, are disposed in the axial direction of the female connector housing 5 in the engaging part 6. In this embodiment, there is no matter whether the male terminals 7 are fixed on such as a printed circuit board of an electric appliance, or connected with ends of electric wires. When the male terminals 7 are fixed on the board of such as the electric appliance, the female connector 2 is fixed on the housing thereof. When the male terminals 7 are connected with the ends of electric wires, the female connector 2 is a movable connector. Incidentally, as shown in FIG. 2, drawing number 34 indicates a front holder.

As shown in FIG. 1, FIG. 2 and FIG. 8, a male connector housing 8 of the male connector 3 is made cylindrically of insulating material. A plurality of accommodating rooms 10, such as 21 rooms in above figures, where a plurality of female terminals 9 are accommodated are provided in an interior of the male connector housing 8. These terminal accommodating rooms 10 are so provided as to penetrate the male connector housing 8 from front to rear, and disposed so that the male terminals 7 are inserted to the female terminals 9 to be connected electrically when the female connector 2 is engaged with the male connector 3.

A plurality of wall parts 11 are provided in the terminal accommodating rooms 10 so as to prevent female terminals 9 from moving forward in the direction of insertion by contact with the end parts of female terminals 9. And lances 12 are resiliently provided in the terminal accommodating rooms 10 so as to prevent the female terminals 9 from dropping out of the terminal accommodating parts 10 by engaging with female terminals 9 detachably.

As shown in FIG. 1 and FIG. 5, three positioning grooves 13 are provided at such as 120 degree intervals on a cylindrical surface of the male connector housing 8 in an axis direction thereof. When engaging the male connector 3 and the female connector 2, positioning parts (not shown) provided on an inner wall of the engaging part 6 in the female housing 5 are inserted into the positioning grooves 13, so that the connectors 2, 3 are positioned.

Figure 7:
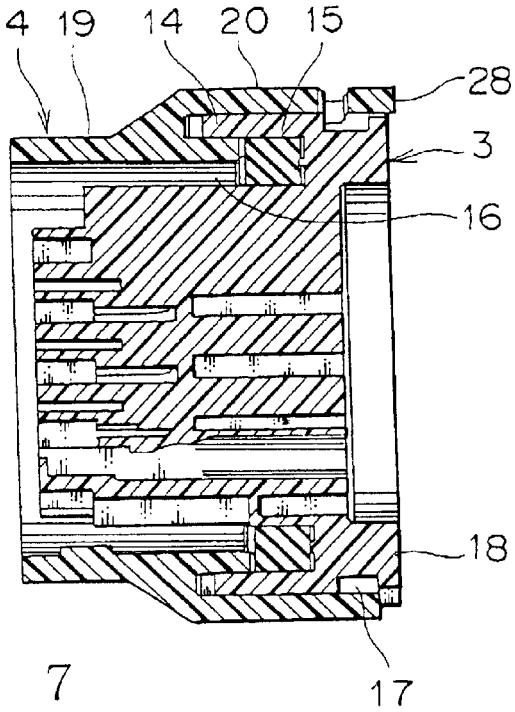
FIG. 7 is a cross sectional view showing the condition of the rotatable member mounted rotatably on the male connector.

As shown in FIG. 2, a cylindrical sealing wall 14 with a larger radius than the male connector housing 8 is provided surrounding from center to rear of the cylindrical surface of the housing 8 at a specific interval in an axis direction thereof. As shown in FIG. 7, a seal material housing 16 is made of the sealing wall 14 and the male connector housing 8, housing seal material 15 in the circular direction of the male connector housing 8. When engaging the male and female connectors 2, 3, an front-end part of the female connector 2 contacts the seal material 15 to press the seal material, so that a space between the male connector 3 and female connector 2 is sealed with the seal material 15.

A rotation supporting groove 17 is provided with a recess-shaped section in a rear side from the seal material housing 16 of the male connector housing 8 in a circular direction of the male connector housing 8.

An extended part 18 is provided in the rear side of the rotation supporting groove 17 of the male connector housing 8 and extended outward radially from such as a rear end part of the male connector housing 8 as shown in FIG. 8. A diameter of the extended part 18 is longer than an outside diameter of the sealing wall 14, and is, for example, as same as an outside diameter of an after-mentioned outer cylinder part 20 of the rotatable member 4.

As shown in FIG. 2, the rotatable member 4 is formed as a dual-cylinder structure made of an inner cylinder part 19 and the outer cylinder part 20. An inside diameter of the inner cylinder part 19 is a little longer than an outside diameter of a front-end part of the female connector housing 5. Further, an inner cylinder part 19 has a cylindrical form of a length from the front-end part of the male connector housing 8 to a near surface of the seal material 15 accommodated in the seal material housing 16.

The outer cylinder part 20 has a cylindrical form and an inside diameter of the outer cylinder part 20 is a little larger than an outside diameter of the sealing wall 14. Further, an end part of the outer cylinder part 20 is provided coaxially with the inner cylinder part 19 in the nearly middle of the inner cylinder part 19. Thus, when the rotatable member 4 is mounted on the male connector housing 8, the front-end part of the sealing wall 14 is positioned between the outer cylinder 20 and the inner cylinder 19.

With regard to a length of the outer cylinder part 20 in the axis direction, the length from the front face of the male connector housing 8 to the extended part 18 is as nearly same as the length from a front surface (counter side of the outer cylinder part 20) of the inner cylinder part 19 to the end part (counter side of the inner cylinder part 19) of the outer cylinder part 20.

As shown in FIG. 1 and FIG. 5, a plurality of rotation support parts 21 are provided at specific intervals in a circular direction of the outer cylinder part 20 on near the end of the outer cylinder part 20. The rotation support parts 21 are formed resilient in the radius direction of the outer cylinder part 20, and sheet-shaped parts. An is provided projecting from an inner wall of the rotation support parts 21. The engaging piece 22 is projected inner than an inner wall of the outer cylinder part 20 toward the center axis thereof. Thus, as shown in FIG. 5, when inserting the rotatable member 4 into the male connector housing 8, then engaging the engaging piece 22 with the rotation supporting groove 17, consequently the rotatable member 4 is positioned coaxially with the male connector housing 8. In this case, the rotatable member 4 is prevented from moving backward in the insertion direction. Further, by contacting the end part of the outer cylinder part 20 with the extended part 18, the rotatable member 4 is prevented from moving forward in the insertion direction, while mounted rotatably on the male connector housing 8. A plurality of fixture holes 23 are provided in the rotatable member 4 according to the number of the rotation support parts 21 so as to insert a tool for bending the rotation support parts 21 for releasing the rotatable member 4 from the male connector housing 8.

A plurality of grooves 24 are provided in the axis direction of the outer cylinder part 20 on the circular face of the outer cylinder part 20, for preventing operator's hand from slipping while rotating the rotatable member 4. In addition, it is possible to replace the grooves 24 with a plurality of projections.

Three projections 25 are provided at specific intervals, such as 120 degree shown in FIG. 1, on near the front-end part of the inside wall of the inner cylinder part 19 in a circular direction thereof. As shown in FIG. 2, the projections 25 is formed projecting inward radially from the inside wall of the inner cylinder part 19 and a projecting length of the projections 25 is shorter than a thickness of the engaging part 6 of the female connector housing 5. The projections 25 are not limited in their shapes, so that a disk shape, as shown in FIG. 1, is acceptable.

A plurality of engaging grooves 26 are provided at specific intervals according to the number of the projecting parts 25, on a circular outside face of the engaging part 6 of the female connector housing 5. For example as shown in FIG. 1, 3 grooves are provided at 120-degree intervals. The projections 25 are inserted into the engaging grooves 26 when engaging the male and female connectors 2, 3. The engaging grooves 26 are formed such as recess shapes in cross-section and formed straight shapes 26*a* from the front-end part for a specific length axially in an opening edge thereof. When the male and female connectors 2, 3 are engaged initially, the projections 25 moves along above straight parts 26*a* axially. End positions of the straight parts 26*a* are initial engaging positions, hereafter described as straight end parts 26*b*.

A plurality of skew parts 26*c* are provided in the engaging grooves 26, skewing almost spirally from the straight end parts 26*b* toward the rear side of the engaging part 6 on the outside face of the engaging part 6 as same direction as the rotation of the rotatable member 4. A plurality of dead end parts 26*d* of the engaging grooves 26 are provided at positions where the each length between the dead end parts 26*d* and the straight end parts 26*b* is as same as a moving distance of the male and female connectors 2, 3 from the initial engaging to the full engaging.

Each length of the skewing parts 26*c* from the straight end parts 26*b* to the dead end parts 26*d* in the engaging grooves 26 is designed optionally according to the skewing shapes of the engaging grooves 26. The smaller the skew angle of the engaging grooves 26 toward the rear side is, the easier it is to rotate the rotatable member 4. However, the engaging grooves 26 are not a single groove, so that the engaging grooves 26 are designed not to interfere with one another. Preferably, the skewing angles around the beginning parts (the straight end parts 26*b*) and around the dead end parts 26 are smaller than the rest of the skewing parts 26*c*.

An engaging arm 27 is mounted on rear-end of the outer cylinder part 20 of the rotatable member 4. An end (rear-end) part of the engaging arm 27 is attached resiliently to the outer cylinder part 20 in the axial direction of the outer cylinder part 20. A convex-shaped projecting part 28 is provided in a front-end (free end) part of the engaging arm 27, projecting toward rear-end of the outer cylinder part 20 coaxially. The projection 28 and the engaging arm 27 are formed integrally with the rotatable member 4. In a case that the extended part 18 is formed disk-shaped without any concave portion, when the rotatable member 4 is mounted rotatably on the male connector housing 8, the projecting part 28 abuts on the extended part 18 to bend the engaging arm 27.

A wall part 28*a* is at a forward side of the engaging of projecting part 28, that is, a foreside wall in the rotation direction from the initial engaging to the full engaging. The wall part 28*a* is positioned almost orthogonal to the rear-end wall of the outer cylinder part 20, that is, in the axis of the outer cylinder part 20, while an opposite side wall part 28*b* is tilted and taper-shaped. Therefore, in a case that a wall is provided in the rotation direction of the projecting part 28, the rotatable member 4 can run forward onto the wall with a relatively large torque, while run backward with a relatively small torque.

Figure 3:
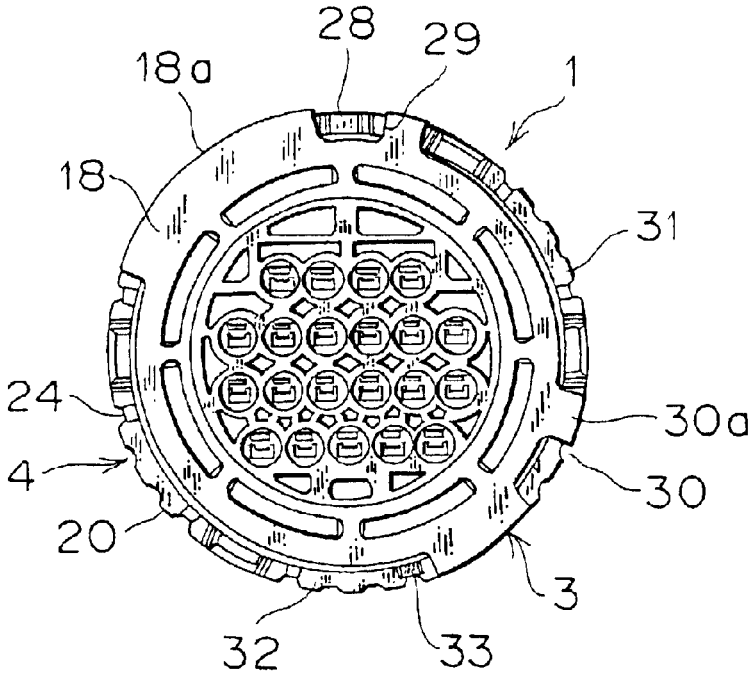
FIG. 3 is a rear view showing an initial engaging condition of the connectors.

As shown in FIG. 3, two recesses 29, 30 engaging with the projecting part 28 of the outer cylinder part 20 are provided in a circular edge part 18*a* of the extended part 18. One recess is an initial engagement recess 29 to keep the rotatable member 4 at the initial engaging position. Another recess is an engaging part 30 where the projecting part 28 is engaged with the rotatable member 4 by rotating from the initial engaging position to the full engaging position. A moving recess 31 is provided as to move the projecting part 28 of the rotatable member 4 easy in between the two recesses 29, 30 of the extended part 18. In a case that the rotatable member 4 is engaged with the engaging part 30 by rotating the rotatable member 4, the projecting part 28 runs onto a wall part 30*a* (a member of the engaging part 30) to be housed in the engaging part 30.

With regard to the projecting part 28 and the engaging part 30, it is not necessary that the front-end part of the projecting part 28 come into contact with the bottom wall of the engaging part 30 when housed in the engaging part 30 to be engaged. However, it is preferable that the rotatable member 4 and the extended part 18 are made of synthetic resin. Because it allows to make a locking sound, such as 'click', by contact between the projecting part 28 and the engaging part 30 and/or by contact between the engaging arm 27 and the engaging part 30 when the projecting part 28 is inserted into the engaging part 30. Incidentally, by rotating the rotatable member 4, the projecting part 28 runs onto the wall part 30*a*, then is inserted into the projecting part 28 with the restitutive force of the engaging arm 27.

To give one example, a first mark is the projecting part 28 of the outer cylinder part 20 and a second mark is the engaging part 30. To give another example, the first mark is the engaging part 30 provided on the outer cylinder part 20 and the second mark is the projecting part 28 formed on the 18. Further, it is not necessary that the first and second marks are provided on the projecting part 28 or engaging part 30. Any configuration is acceptable as far as the first and second marks indicate whether the male and female connectors are fully engaged with each other. For example, one projection is provided on the end part of the outer cylinder part 20, and the other projection is provided on the circular end part of the extended part 18 to overlap together when the male and female connectors 2, 3 are fully engaged with each other. Further, to give another example instead of above projections, such as red straight marks are provided, extended in the axis direction, so that the marks are disposed in a straight line when the pair of the connectors is engaged fully with each other.

Further, it is acceptable not only that the two marks are provided on the rotatable member 4 and the male connector 3, but also that the two marks are provided on the rotatable member 4 and the female connector 2.

As shown in FIG. 3 or FIG. 4, a backlash preventing recess 32 is provided on the rest of the extended part 18 as a second moving space as long as a space between the two recesses 29 and 30. A backlash preventing rib 33 is provided on the end part of the outer cylinder part 20 of the rotatable member 4, projecting in the axis direction of the outer cylinder part 20, so as to be engaged with the backlash preventing recess 32. The backlash preventing rib 33 is provided to abut on or be positioned near one wall composing the backlash preventing recess 32 when the rotatable member 4 is at the initial engaging position, and to abut on or be positioned near the other wall when the rotatable member 4 is rotated to the full engaging position. Thus, the rotatable member 4 is allowed to move only from the initial engaging position to the full engaging position and vice verse.

As shown in FIG. 5, In order to connect the pair of the male and female connectors 2, 3, firstly female terminals 9 are accommodated in the terminal accommodating rooms 10 of the male connector housing 8. Secondly, the rear-end part of the outer cylinder part 20 of the rotatable member 4 is inserted into the male connector housing 8 from the end part thereof. Thirdly, the engaging piece 22 is engaged with the rotation-supporting groove 17, so that the rotatable member 4 is mounted rotatable. Fourthly, the projecting part 28 of the outer cylinder part 20 is engaged with the initial engagement recess 29 of the extended part 18. Fifthly, the front-end part of the male connector 3 containing the rotatable member 4 is inserted into the engaging part 6 of the female connector 2 as an initial engaging. The projections 25 reach the straight end parts 26*b* from openings of the engaging grooves 26 via straight parts 26*a*.

At this time, the male and female connectors are not allowed to be engaged with each other unless the engaging grooves 26 provided on the outside face of the front-end part of the male connector 3 and the projections 25 provided on the inner wall of the engaging part 6 of the female connector 2 are engaged with each other. Thus, the male and female connectors may not happen to be engaged incompletely. Further, the rotatable member 4 is maintained at the initial engaging position by the engaging of the projecting part 28 with the initial engagement recess 29. Thus, the initial engaging of the male and female connectors 2, 3 is easy to achieve with no displacement of the projections 25 by rotating the rotatable member 4.

In the initial engaging condition of the male and female connectors, the projecting part 28 as the first mark runs onto the wall of the initial engagement recess 29 from the initial engagement recess 29 with the rotatable member 4 rotating toward the engaging direction, so that the engaging arm 27 is bending. Further, the projections 25 abut the wall of the engaging grooves 26 of the female connector 2. At this time during from the projecting part 28 running onto the wall part of the initial engagement recess 29 to entering into the moving recess 31, the torque for rotating the rotatable member 4 is larger than the torque for that without running onto the wall part of the initial engagement recess 29. However, by turning down the tilt angle of the engaging grooves 26, the rotatable member 4 is rotated with relatively small torque.

The projections 25 press the wall parts of the engaging grooves 26 toward the front-end part of the female connector 2 by rotating the rotatable member 4. On the contrary, in the case that the female connector 2 is fixed, the male connector 3 moves toward the engaging position. According to the rotation of the rotatable member 4, the male connector 3 moves so that the projections 25 move into around the dead end parts 26*d* of the engaging grooves 26. At this time, the projecting part 28 enters into the engaging part 30 after running onto the wall part 30*a*, and the projections 25 reach the dead end parts 26*d*. Thus, the projecting part 28 and the engaging part 30 are engaged with each other, and the male and female connectors 2, 3 are engaged fully with each other, so that the male and female connectors 2, 3 are electrically connected with each other.

At this time during from the projecting part 28 running onto the wall part 30*a* to entering into the engaging part 30, the torque for rotating the rotatable member 4 is larger than the torque for that without running onto the wall part of the engaging part 30. However, by turning down the tilt angle of the engaging grooves 26, the rotatable member 4 is rotated with relatively small torque.

Therefore, when the male and the female connectors are fully engaged with each other by rotating the rotatable member 4, the projecting part 28 as the first mark 1 formed integrally with the rotatable member 4 and the engaging part 30 as the second mark 2 formed on the male connector 3 are fully engaged with each other. Thus, the projecting part 28 and the engaging part 30 indicate whether the male and female connectors 2 and 3 are fully engaged or not, so that the electrical connector assembly 1 of the present invention allows to confirm the full engagement condition easily without additional parts.

As described above, when the male and female connectors 2, 3 are fully engaged with each other, the projecting part 28 is engaged with the engaging part 30, while when the connectors are not fully engaged, the projecting part 28 is not engaged with the engaging part 30. Thus, the full engagement condition is ascertained on sight. Additionally, when the male and female connectors 2 and 3 are fully engaged with each other, the projecting part 28 and the engaging part 30 is engaged with each other, so that the rotatable member 4 holds the full engagement position and is prevented from rotating easily.

In a case that the wall part 28*a* is formed in the axis direction of the rotatable member 4, a relatively large torque is required to rotate the rotatable member 4 for engaging so that the projecting part 28 runs onto the wall part 30*a*. When the projecting part 28 runs through the wall part 30*a* and enters into the engaging part 30, a large difference of the torque amounts evokes adequate perceivable feeling. Further, using a slope tapered figure of the wall part 28*b* in rear of the engagement, the rotatable member 4 rotates with a relatively small torque for unlock the engagement of the male and female connectors 2, 3. Thus, the connector assembly 1 is easy to unlock the engagement thereof.

The rotatable member 4 and the extended part 18 are made of synthetic resin to make a locking sound such as 'click' by the contact between the projecting part 28 and the engaging part 30 and/or between the engaging arm 27 and the engaging part 30. Above contacts are caused by rotating the rotatable member 4, so that the projecting part 28 enters into the engaging part 30 with a restitutive force of the engaging arm 27 after running onto the wall part 30*a*. Thus, when the male and the female connectors 2, 3 are fully engaged with each other by rotating the rotatable member 4, the locking sound is generated to be ascertained whether the male and female connectors 2, 3 are fully engaged with each other. In this case, the longer the projection length of the projecting part 28 is, the higher the locking sound sounds. However, the overlong projecting part 28 is not allowed to run onto the wall part of the initial engagement recess 29 nor the engaging part 30, or requires a huge torque to do that. So, preferably the projecting part 28 is formed with a so long projection as to run onto the wall parts of the initial engagement recess 29 and engaging part 30 with a proper torque.

What is claimed is:

1. An electrical connector assembly comprising:

a pair of connectors, said pair of connectors being engaged fully by way of implementing initial engagement, rotating a rotatable member mounted rotatably on either one of said connectors and moving at least either of said connectors in a direction of engagement, whereby a projection and an engaging arm are provided on said rotatable member and an engaging part is so provided on an extended part as to be ascertained whether or not said pair of connectors is fully engaged with each other together, wherein the extended part is in a rotation supporting groove of one of said pair of connectors.

2. The electrical connector assembly as claimed in claim 1, wherein an initial engagement recess is so mounted on either said one of connectors on which said rotatable member is mounted or said rotatable member as to hold said rotatable member in an initial engagement position by engaging with said projection.

3. An electrical connector assembly comprising:

a pair of connectors, said pair of connectors being engaged fully by way of implementing initial engagement, rotating a rotatable member mounted rotatably on either one of said connectors and moving at least either of said connectors in a direction of engagement, whereby a first mark is provided on either said rotatable member or said one of connectors on which said rotatable member is mounted and a second mark is so provided on either said one of connectors or said rotatable member as to be ascertained whether or not said pair of connectors is fully engaged with each other together with said first mark, wherein either said first or second mark is a projection formed on an engaging arm which is mounted resiliently on either said rotatable member or said one of connectors, and either of said marks is an engaging recess with which said projection is engaged, wherein said projection and/or said engaging arm and said engaging recess are made of synthetic resin with which, when said projection enters said engaging recess caused by restitutive force of said engaging arm being bent by rotation of said rotatable member, a locking sound is caused from a contact between said projection and said engaging recess and/or a contact between said engaging arm and a wall which forms said engaging recess.

4. An electrical connector assembly comprising:

a pair of connectors, said pair of connectors being engaged fully by way of implementing initial engagement, rotating a rotatable member mounted rotatably on either one of said connectors and moving at least either of said connectors in a direction of engagement, whereby a first mark is provided on either said rotatable member or said one of connectors on which said rotatable member is mounted and a second mark is so provided on either said one of connectors or said rotatable member as to be ascertained whether or not said pair of connectors is fully engaged with each other together with said first mark, wherein either said first or second mark is a projection formed on an engaging arm which is mounted resiliently on either said rotatable member or said one of connectors, and either of said marks is an engaging recess with which said projection is engaged, wherein an initial engagement recess is so mounted on either said one of connectors on which said rotatable member is mounted or said rotatable member as to hold said rotatable member in an initial engagement position by engaging with said projection, wherein said projection and/or said engaging arm and said engaging recess are made of synthetic resin with which, when said projection enters said engaging recess caused by restitutive force of said engaging arm being bent by rotation of said rotatable member, a locking sound is caused from a contact between said projection and said engaging recess part and/or a contact between said engaging arm and a wall which forms said engaging recess.

* * * * *

UNITED STATES PATENT AND TRADEMARK OFFICE

CERTIFICATE OF CORRECTION

PATENT NO. : 6,811,423 B2 
DATED : November 2, 2004
INVENTOR(S) : Yoshigi, Toshimasa et al.

It is certified that error appears in the above-identified patent and that said Letters Patent is hereby corrected as shown below:

Title page,
Item [73], Assignee, "Yazaki Corporation, Tokyo (JP)" to be -- Yazaki Corporation, Tokyo (JP); Jatco Ltd, Shizuoka (JP) --.

Signed and Sealed this

Twenty-eighth Day of March, 2006

JON W. DUDAS
*Director of the United States Patent and Trademark Office*